United States Patent [19]

Kahan

[11] 4,127,254

[45] Nov. 28, 1978

[54] CONCRETE BUILDING CONSTRUCTION FORMS

[76] Inventor: Ghetel P. Kahan, Av. Sojo Edificio El Escorial, El Rosal, Caracas, Venezuela

[21] Appl. No.: 721,651

[22] Filed: Sep. 8, 1976

[51] Int. Cl.[2] ..... E04G 11/02

[52] U.S. Cl. ..... 249/22; 249/27; 249/181; 249/192; 249/219 R

[58] Field of Search ..... 425/62; 52/584; 249/19, 249/26, 27, 178, 180–182, 184, 186, 219 R, 192

[56] References Cited

U.S. PATENT DOCUMENTS

| | | | |
|---|---|---|---|
| 3,482,005 | 12/1969 | Quentin | 249/19 |
| 3,628,223 | 12/1971 | Babee | 249/20 |
| 3,656,732 | 4/1972 | St. John | 249/179 |
| 3,689,018 | 9/1972 | Pelle et al. | 249/26 |
| 3,689,019 | 9/1972 | Ferenc | 249/27 |
| 3,693,927 | 9/1972 | Jennings | 249/27 |
| 3,847,521 | 11/1974 | Stickler, Jr. | 249/27 |

FOREIGN PATENT DOCUMENTS

| | | | |
|---|---|---|---|
| 2,239,124 | 2/1975 | France | 249/180 |
| 943,971 | 12/1963 | United Kingdom | 249/219 R |

*Primary Examiner*—Francis S. Husar
*Assistant Examiner*—John McQuade
*Attorney, Agent, or Firm*—Toren, McGeady and Stanger

[57] ABSTRACT

In forming a concrete structure, reusable modular forms are joined together to provide one or a number of tunnel-like sections. The forms include inside form units which can be connected together and aligned so that they provide a continuous planar surface. Outside form walls and other form sections combine with the inside form units in completing the form required to pour in one monolitic pour one section of the concrete structure, consisting of load bearing concrete walls, slabs, and in the case of multistory structure, (wall) curbs. Removable central keys are a part of the top surface of each inside form unit and by removing the keys, the inside form units can be stripped from a poured section, moved and positioned for pouring another section. Turnbuckles attached to each inside form unit enable them to be secured in position to pour one section and, after the section has been poured, to strip the form unit so that it can be moved and reused. The forms can be used in pouring multiple sections on a single level or for pouring vertical lifts of a multi-level structure.

13 Claims, 13 Drawing Figures

CONCRETE BUILDING CONSTRUCTION FORMS

SUMMARY OF THE INVENTION

The present invention is directed to a modular type of form for concrete construction where multiple pours are to be made on a single level or in a multi-level building. More particularly, the invention concerns form members which can be connected together so that their forming surfaces permit the construction of continuous and smooth concrete surfaces.

Various types of modular forms are known for forming concrete structures, particularly for making repetitive pours. Such repetitive pours may involve constructing similar sections of a building all on one level or constructing the individual levels or stories of a multi-level building. Though a considerable volume of a building can be poured in a single section, it is important to use relatively small modular form units for use in moving, lifting and setting the forms. However, where multiple form sections are utilized, a problem often arises in connecting the forms together and aligning their forming surfaces so that a smooth continuous surface is provided when the concrete is poured. If, after the form members are stripped, there are imperfections in the concrete surface, such as fin-like projections, recesses or the like, considerable and expensive manual labor is required to place the concrete in its proper surface condition.

Another problem involves the stripping of inside form sections or units, since this often is a time-consuming problem and may result in damage to the forms in carrying out the stripping operation.

Therefore, it is a primary object of the present invention to provide form for making multiple repetitive concrete pours where the problems experienced in the past are overcome. An important characteristic of the invention is the ability to set and strip the forms in a quick and simple manner and to provide form sections which can be easily connected together with their surfaces aligned so that a continuous smooth surface can be provided by the surfaces of the forms avoiding the formation of surface imperfections, especially at the joints between aligned form members.

In accordance with the present invention, at the outset, footings or (wall) curbs are constructed defining the lower ends of the walls to be formed. Inverted U-shaped inside form units are placed in position with their lower ends alongside the footings or curbs. The inside form units consist of upwardly extending side surfaces and top surfaces, extending between the side surfaces on which a roof or ceiling slab can be poured. Each top surface includes a removable central key which, when in place, forms a continuation of the top surface. Further, each of the inside form units includes a turnbuckle or similar member for pulling the side surfaces of the form unit together or forcing them apart, until their bottom lower ends are pressed against the (wall) curbs.

With the inside form units in position against the (wall) curbs, they are brought to the proper height level with the central key in position and then adjoining form units, which provide a continuous tunnel-like section, are connected together and aligned. Any inserts in the walls of the concrete structure to be poured are mounted on the side surface of the inside form units, such inserts may include door or window frames as well as pipes or conduits for the electrical and plumbing systems to be incorporated into the buildings being formed. In addition, to form the exterior (end) walls of the outside (or end) wall, forms can be secured to the outside concrete structure of the (wall) curbs, set at the proper height and then connected to adjacent aligned inside form units. Removable rods or rods with removable sections can be used for interconnecting juxtaposed outside wall forms and inside form units and also for interconnecting laterally coextensive inside form units. The rods assure the requisite spaced separation between the various wall forms defining the space into which concrete is poured. To form "transverse" walls, i.e. walls perpendicular to the direction of the continuous tunnel-like sections, the adjacent open ends of the inverted 'U'-shaped inside form units are closed by transverse wall forms, leaving a space equal to the thickness of the concrete wall to be poured.

To form any framed openings in the top surface, opening frames are set on the top or upper surface of the inside form units. These openings may be required for elevetors, staircases, openings through the roof, plumbing and other fixtures.

If the forms are being used for constructing a multi-level building, form members can be mounted on the upper portions of the forms already set to provide the necessary (wall) curbs for the next level to be formed.

To define the horizontal extent of the concrete structure, i.e. the limits of the concrete walls and the perimeters of the concrete slab, other form units are placed between the adjacent walls of the tunnel-like sections and on the upper surfaces of the inside form units.

The form for pouring a section of the structure is now ready and concrete can be poured into the form and vibrated for constructing the walls and ceiling or roof of the structure.

After the concrete has set for a required period, the forms can be stripped for movement to the next section to be poured. This may involve moving the forms along the same level or removing the inside form units from the tunnel-like section they have defined and lifting them on top of the just-formed concrete for forming another level of the structure. In removing the inside form units, the supports for the forms are raised from the surface on which they are supported, the central key is removed and the turnbuckle is operated for effecting the inward movement of the side walls of the form units for detaching them from the poured wall surfaces. With the inner form units stripped from the concrete, the units drop onto the subjacent support surface and can be wheeled or rolled out of the tunnel-like structure formed into position to provide a new section of the structure.

After the removal of the inside form units, the preparation of the ceilings and walls for painting can be performed.

If the forms are being utilized to build a multi-level structure, scaffolding can be placed on the previously poured subjacent lifts to support inside form units as they are moved out of the tunnel-like section formed into position to be lifted to form the next lift of concrete.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE INVENTION

Figure 1:
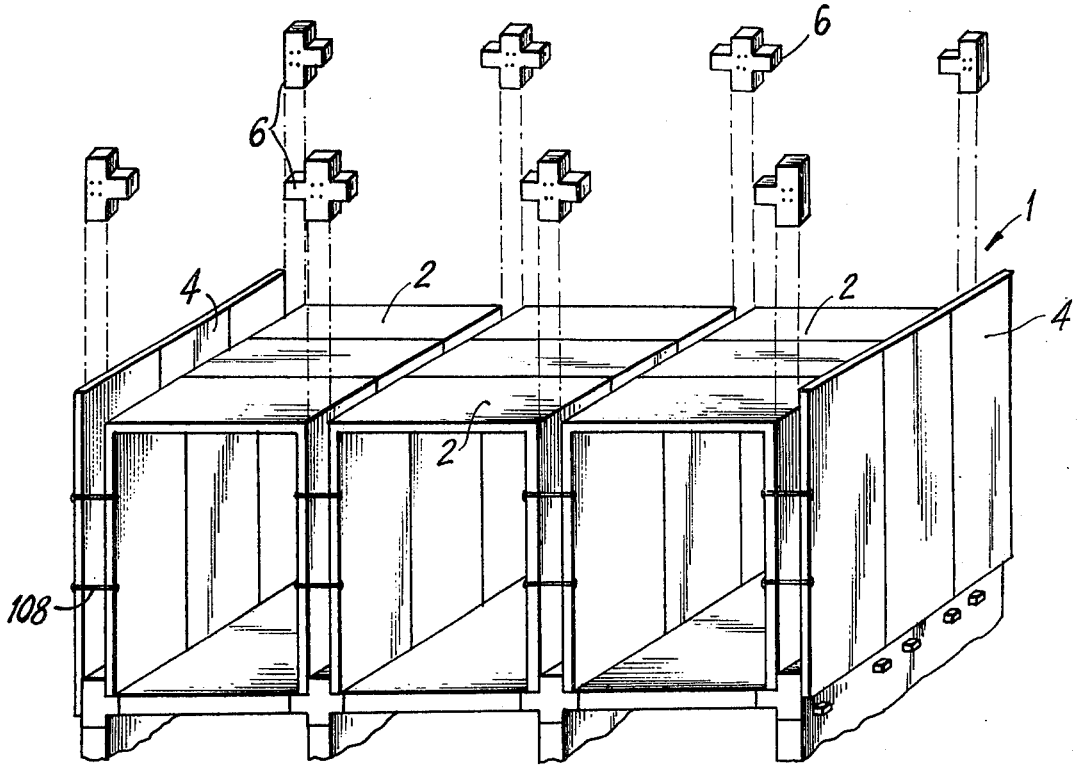
FIG. 1 is a perspective view showing schematically a number of forms joined together in accordance with the present invention for forming a section of a poured concrete structure.
Figure 1A:
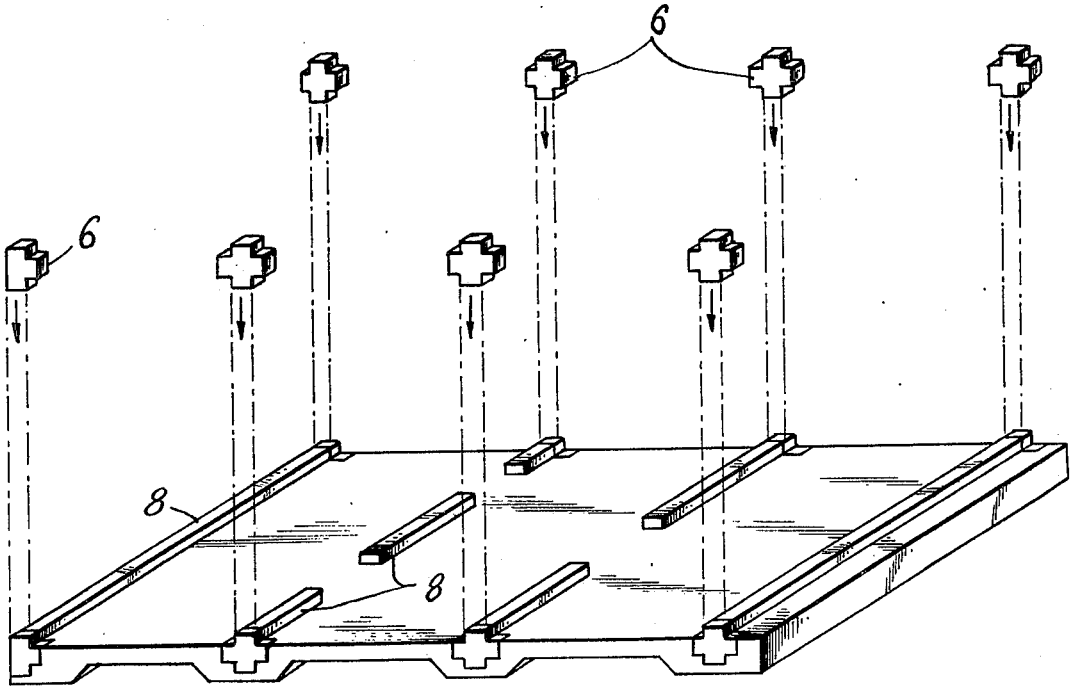
FIG. 1A is a perspective view illustrating the formation of curb walls for positioning the lower ends of the forms.

In FIG. 1, a form 1 is shown schematically in a partially completed state for forming a vertical lift of concrete. The form as illustrated consists of three rows of inside form units 2 with outside wall forms 4 located outwardly from the outer side of each of the two outer rows of inside form units. To place the form 1 in condition to pour concrete and to define all limits of the space where concrete is to be poured, end forms or bulkheads, not shown, would be located at each of the opposite ends of the spaces between adjacent vertical form surfaces and on the top surfaces of the tunnel-like sections. Further, cross-shaped and tee-shaped members 6 are shown above the form, and, as indicated by the dotted lines, these members are inserted between the forms at the upper end and provide guides and supports for the formation of (wall) curbs 8 as shown in FIG. 1A. The (wall) curbs are used for locating the lower ends of the forms as they are set in position.

In FIG. 1A it can be noted how the cross-shaped and tee-shaped members are utilized for forming the opposite ends of the (wall) curbs 8.

The forms shown in FIG. 1 can be used in construction of a multi-level building or they can be used in forming continuous sections of a building located all on the one level.

Figure 2:
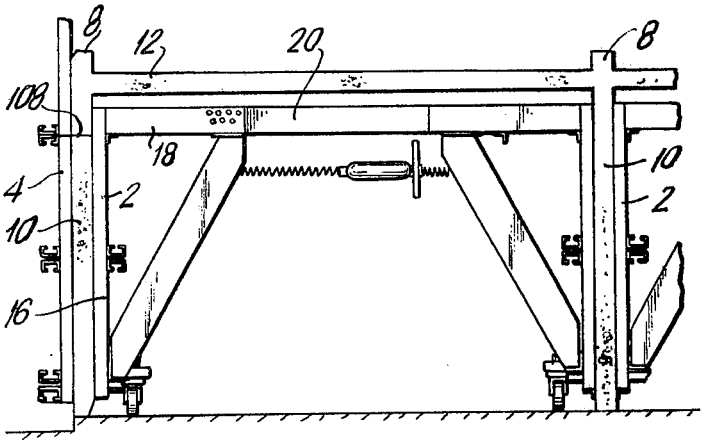
FIG. 2 is an end view of one portion of a form embodying the present invention with the concrete poured into the form.

In FIG. 2, an inside form unit 2 is illustrated with an outside wall form 4 shown on its left side and another inside form unit disposed on its right side. The concrete has been poured into the form in FIG. 2 and consists of side walls 10 and top slab or wall 12 which may form a roof or ceiling of a subjacent space and the floor of the superjacent space. In addition, (wall) curbs 8 are shown extending upwardly from the top wall 12 and would be used in aligning the form sections for the next lift or level of concrete. The structure of the walls of the various form sections is of a conventional type, accordingly, no description is provided. However, the walls are adequately braced and reinforced to meet the various loading conditions experienced when concrete is poured into and vibrated within the forms. In FIG. 2 the top of the inside form unit 2 is stripped from and spaced downwardly below the lower surface of the top slab 12.

Figure 3:
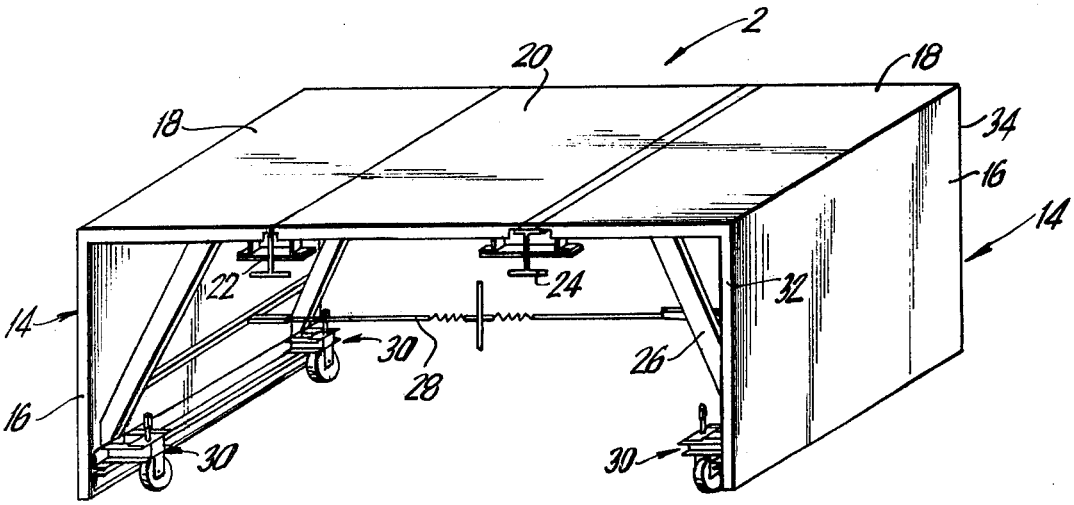
FIG. 3 is a perspective view of an inside form unit embodying the present invention which forms an interior or tunnel-like portion of a poured concrete structure.

As can be seen in FIGS. 2 and 3, the inside form units 2 include a pair of laterally spaced inverted L-shaped members 14 each having a vertically extending leg 16 and a horizontally extending leg 18 connected to the upper end of the vertically extending leg. While an inside form unit may be made up only of the two L-shaped members 14, for increasing the width of the inside form unit a horizontal extension plate 20 is used, the width of the plate can be varied to accommodate the width of the structure to be formed by the inside form unit. The extension plate 20 is braced and reinforced to withstand the forces developed during and following the concrete pouring operation.

As illustrated in FIG. 3, a schematically shown alignment device 22 is provided between the lefthand edges of the extension plate 20 and the adjoining edge of the leg 18 for aligning the juxtaposed edges and holding them together. A central key 24 is inserted between the adjacent righthand edge of the extension plate 20 and the adjacent edge of the righthand leg 18. Knee braces 26 extend between the vertically extending leg 16 and the horizontally extending leg 18 to provide the required support for the form. Extending transversely between the vertically extending legs 16 of the L-shaped members 14 is a turnbuckle 28 which can either force the vertically extending legs or sidewalls 16 outwardly or pull them inwardly toward one another.

Each of the L-shaped members 14 has a pair of rolling support members 30, one located near its front and the other near its rear end. For the purpose of this description the edge of the front end of the inside form unit 2 is designated by reference numeral 32 and its rear end edge is designated by the reference numeral 34.

Figure 5:
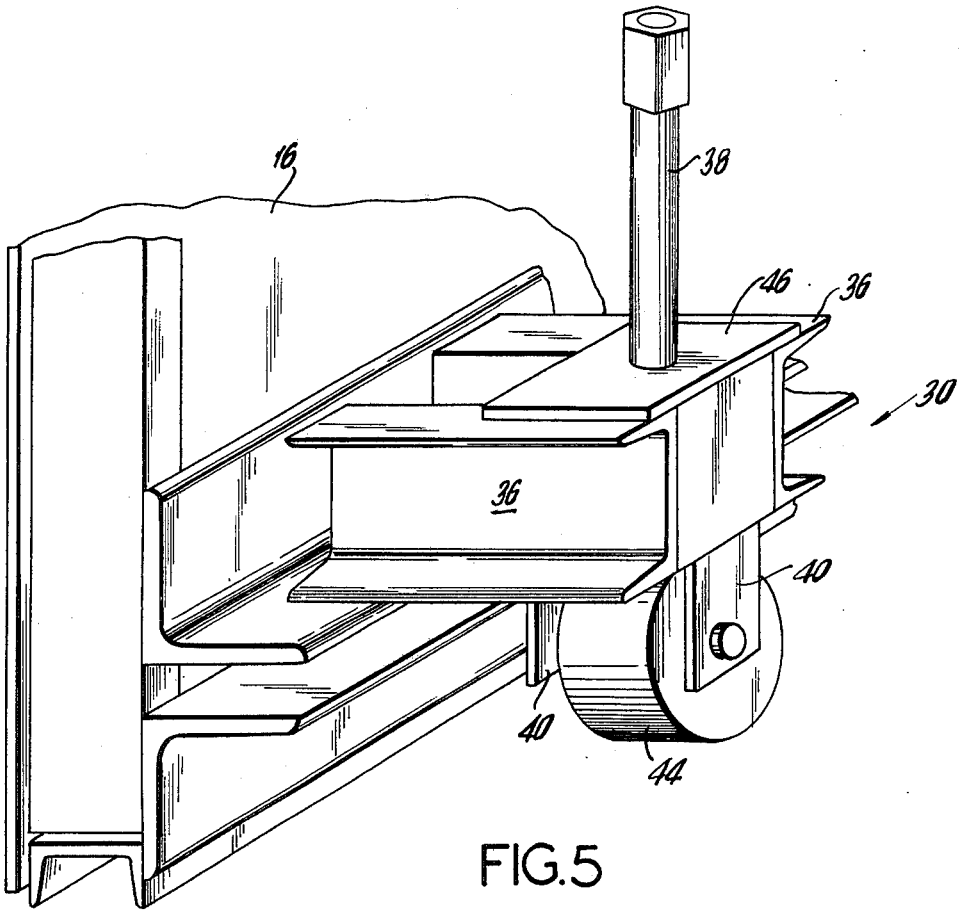
FIG. 5 is one embodiment of a movable support for the inner form section shown in FIG. 3.

The rolling support members 30 are shown in an enlarged view in FIG. 5. Each rolling support member 30 comprises a pair of support channels 36 secured to the lower end of the vertically extending leg 16 of the L-shaped members 14. A threaded adjusting rod 38 extends downwardly through a support plate 46 and a nut (not shown) fastened to the support channels 36 and is connected at its lower end to a pair of housed wheel support plates 40. A wheel 44 is mounted between the wheel supports 40. By means of the adjusting rod 38, with the wheel 44 resting on a support surface, the height of the inside form unit can be adjusted to a desired position. Furthermore, as will be explained later, it is possible, when the inside form unit 2 is secured in position with the concrete poured, to lift the wheel 44 upwardly from its support surface to assist in stripping the unit from the poured concrete.

Figure 6:
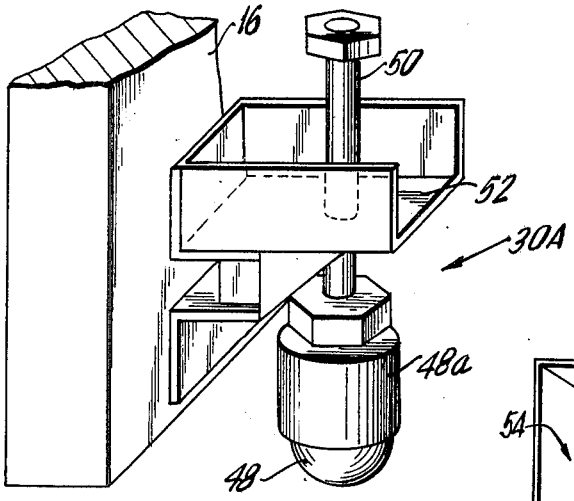
FIG. 6 is an embodiment of a movable support for the outside form section or endwall form.

In FIG. 6, an alternate rolling support member 30A is shown which uses a ball-shaped rolling member 48 and support 48A instead of the wheel supports 40, and wheel 44. The rolling member 48 permits movement of the inside form unit 2 in any desired direction and functions the same as the rolling support member of FIG. 5. The support 48A for the rolling member 48 is connected to the lower end of a threaded adjusting rod 50 which passes downwardly through a support channel 52 attached to the leg 16. The height of the inside form unit can be adjusted by the threaded rod 50 passing through the support channel 52.

Figure 7:
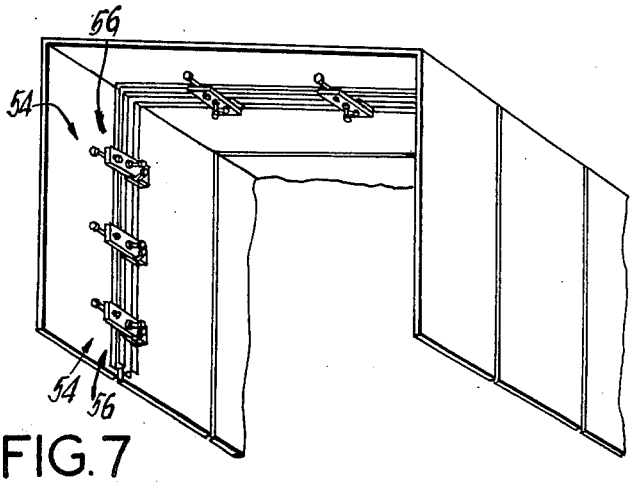
FIG. 7 is a partial perspective view of two coupled inside form sections shown in FIG. 1 schematically illustrating the connecting and aligning members between adjoining form units.

As schematically indicated in FIG. 7, the adjacent inside form units in each row are connected together so that they provide a continuous planar side and top surface against which the concrete is poured. The continuous planar surfaces are provided by union clamps 54 for connecting the inside form units 2 together and by aligners 56 for placing the surfaces of the form units in alignment at the joint between abutting front end and rear end edges. As shown in FIG. 7, the rear end edge of one inside form unit abuts against the front edge of the next rearward inside form unit and union clamps 54 and aligners 56 are provided along the abutting edges on the inwardly facing side surface and top surfaces of the form units.

Figure 8:
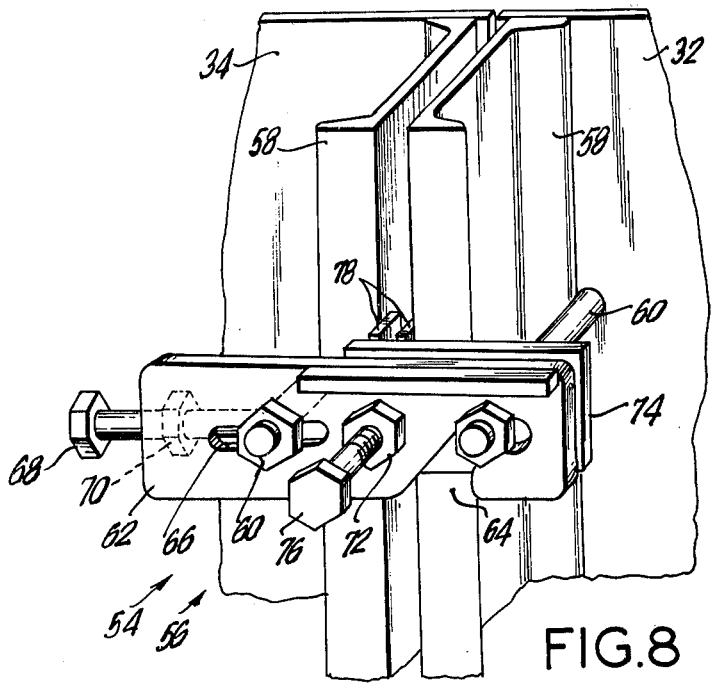
FIG. 8 is an enlarged perspective view of the connecting and aligning members shown schematically in FIG. 7.

In FIG. 8, an enlarged detail view is provided of a union clamp 54 and an aligner 56. As indicated in FIG. 7, these union clamps and aligners are located on both the inside side and top surfaces of the inside form units, however, the arrangement of these devices is the same whether located on a side or top surface, accordingly, the single illustration of FIG. 8 is sufficient to indicate their structure and function.

At the joint between the front end edge 32 of one inside form unit 2 and the rear end edge 34 of another, a channel-shaped member 58 is secured to the inside surface of each form unit adjacent to and along the linear extent of the joint. The channel-shaped members 58 are spaced apart and at the location of each union clamp, a threaded stud 60 is attached to each of the channel-shaped members 58 and extends inwardly beyond the inner surface of the member. The union clamp 54 consists of an elongated plate 62 extending across the inner ends of the channel-shaped members 58. The plate 62 has a slot 64 extending obliquely of the elongated direction of the plate and opening from one of its sides so that the slot can be fitted over one of the studs 60. Spaced from the slot 64 there is an oval-shaped opening 66 in the plate having its long dimension extending in the elongated direction of the plate and it is arranged to fit over the other stud 60. A threaded adjusting member 68 extends through a nut 70 fixed to the plate and by threading the adjusting member through the nut it bears against the stud located in the opening 66 so that the two adjoining inside form units are positioned in abutting relation by the force exerted by the adjusting member.

Adjacent the union clamp 54 is the aligner 56 for placing the forming surfaces of the adjacent inside form units in a continuous planar condition. The aligner 56 shares with the union clamp 54, the studs 60 and the plate 62. An aligner plate 74 is mounted on one of the studs 60, between the plate 62 and the channel-shaped members 58, pivoting around the stud 60. A threaded adjusting member 76 extends through a nut 72 fixed to the plate 62, and by threading the adjusting member through the nut 70 and plate 62 it bears on the plate 74. A separate aligning rule 78 is attached to each of the channel-shaped members 58 and the plate 74 is arranged to contact the edges of the aligning rules projecting outwardly from the channel-shaped member 58. The outwardly projecting edges of the rules are each spaced the same distance from the forming surfaces of the form unit to which they are attached. The plate 74 under the force applied by the end of the adjusting rod 76 closer to the aligning rules as it is moved toward the rules forces the adjacent end surfaces or edges of the aligning rules 78 into the same plane with the plate 74 and, accordingly, the surfaces of the adjoining inside form units 2 are aligned.

A similar, but considerably simpler, aligning arrangement is used for placing the upwardly facing surfaces of the left-hand L-shaped member 14 and the horizontal extension plate 20 in a continuous planar relation. However, the structure of the central key 24 is somewhat different to permit the key to be inserted into and removed from the space between the right-hand L-shaped member 14 and the juxtaposed edge of the horizontal extension plate 20.

Figure 4:
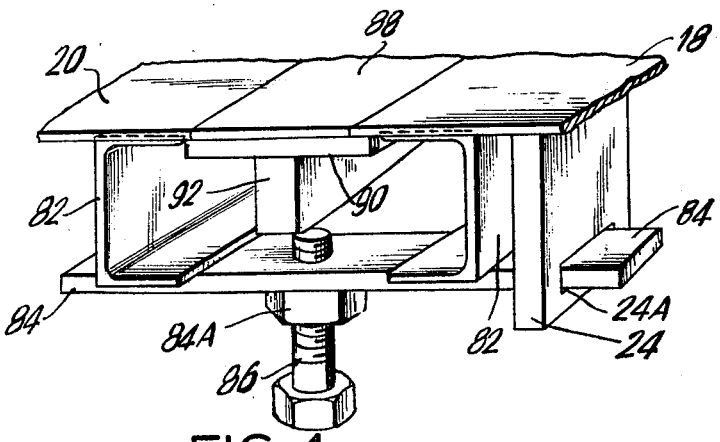
FIG. 4 is a perspective view of an alternate arrangement of a portion of the top surface of the inside form unit shown in FIG. 3.

As shown in FIG. 4, on each side of the central key there is a channel-shaped member 82, similar to members 58. Fixed to the vertical side of one of the members 82, there is a plate 24 with a horizontal slot 24A. Through the slot 24A passes a support plate 84. The plate 84 has an opening and a nut 84A fastened over it, through which a threaded adjusting member 86 can be inserted in threaded relation with the nut. The member 86 is aligned below central key plate 88 for lifting it into position. The key plate 88 includes a stop plate 90 fixed to the lower side of the key plate with the stop plate extending laterally beyond the edges of the key plate. The key plate has a width dimensioned for exactly closing the space between the adjacent horizontally extending leg 18 and horizontal extension plate 20. Further, the thickness of the key plate is the same as the surface plate of the two adjoining form members so that the stop plate aligns the upper surface of the key plate with the adjacent upper surfaces of the other two form members when it, the stop plate, contacts the undersurface of these two members. A stem 92 is connected to and extends downwardly from the undersurface of the stop plate 90 so that, in cross-section, the key plate, stop plate and stem have a tee-shaped appearance. The lower end of the stem is contacted by the adjusting member 86 in lifting and holding the key plate in position.

Figure 9:
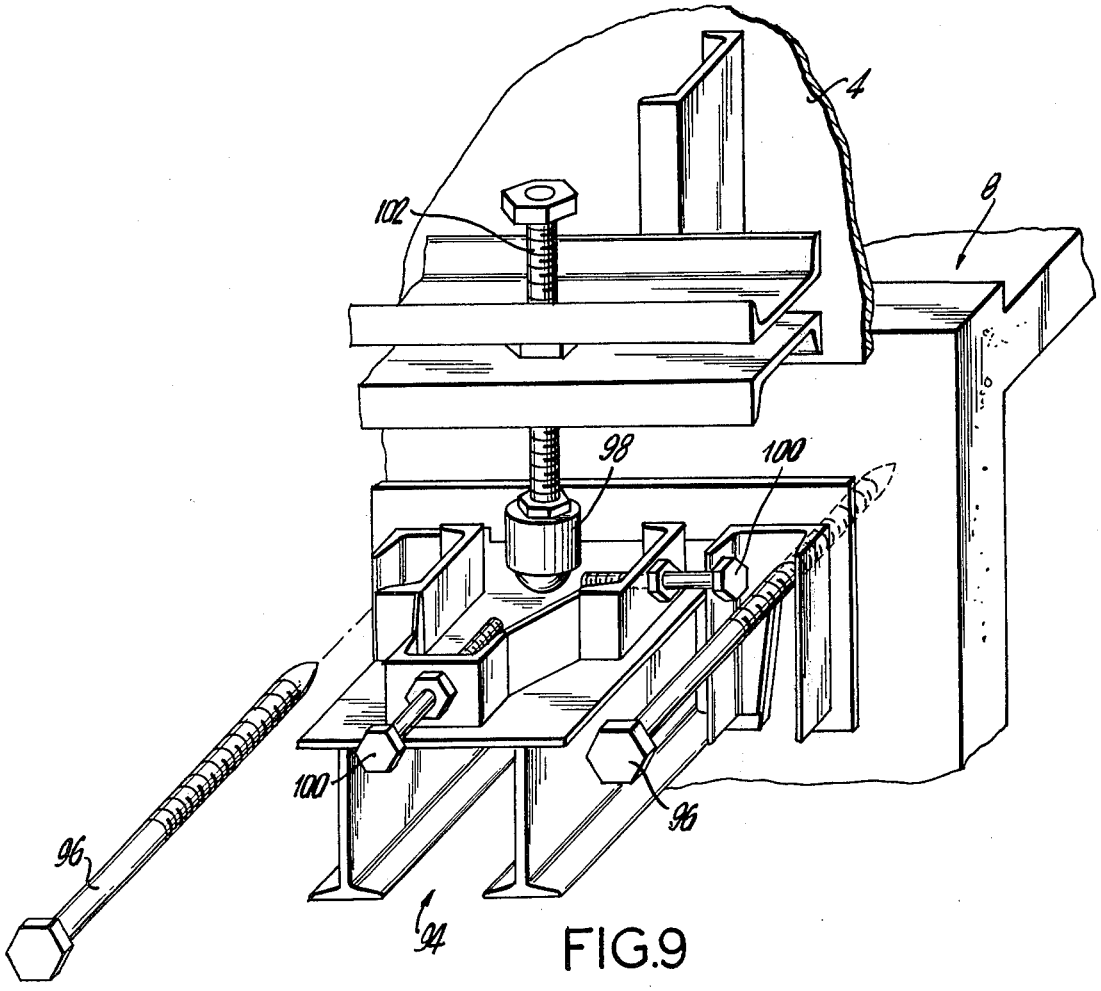
FIG. 9 is an enlarged perspective view of a support arrangement for an outside wall form as shown in FIGS. 1 and 2.

In FIG. 9, the lower end of an outside wall form 4 is shown supported off a previously poured wall. The support arrangement for the outside wall 4 includes a seat member 94 connected to the wall and (wall) curb 8 by a pair of threaded rods 96. The rods 96 are threaded into anchors cast in the wall. A ball support member 98, similar to the rolling member 48 and to the support 48A, rests on the upper surface of the seat member 94. Threaded adjusting members 100 are fixed to the upper surface of the member 94 to adjust the location of the outside wall form and to limit the movement of the ball support member and to hold it in position once the wall form is located in relation to the structure to be poured. By turning the threaded adjusting rod 102, the outside wall form 4 can be lifted or lowered to the desired height.

As can be seen in FIGS. 1 and 2, spacer-connector rods 108 extend through the outside wall forms and the adjacent inside form units or between laterally extending inside form units 2 for interconnecting the forms and providing the requisite spacing between their facing surfaces. The rods 108 or portions of them can be removed when the form is stripped.

Figure 10:
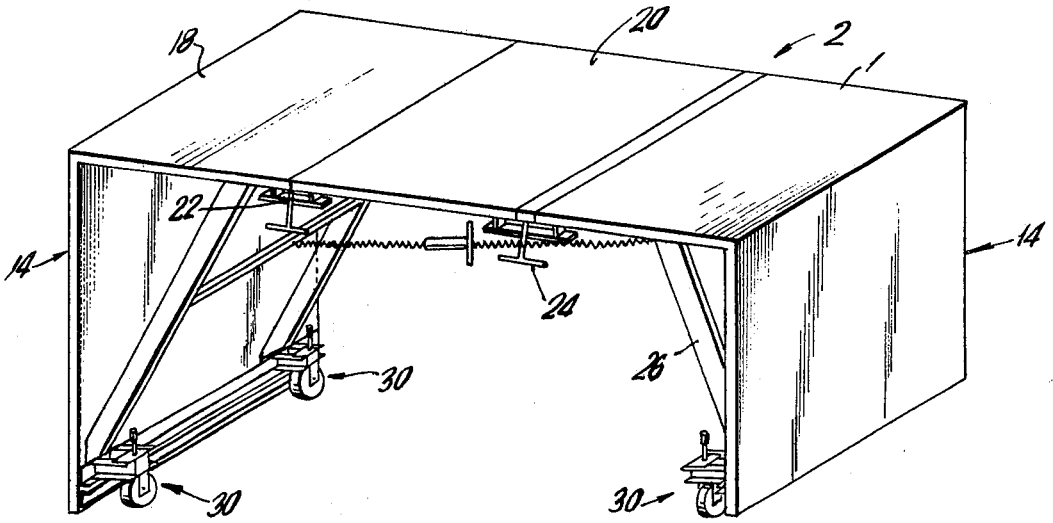
FIG. 10 is a perspective view of another embodiment of the inside form unit shown in FIG. 3.
Figure 11:
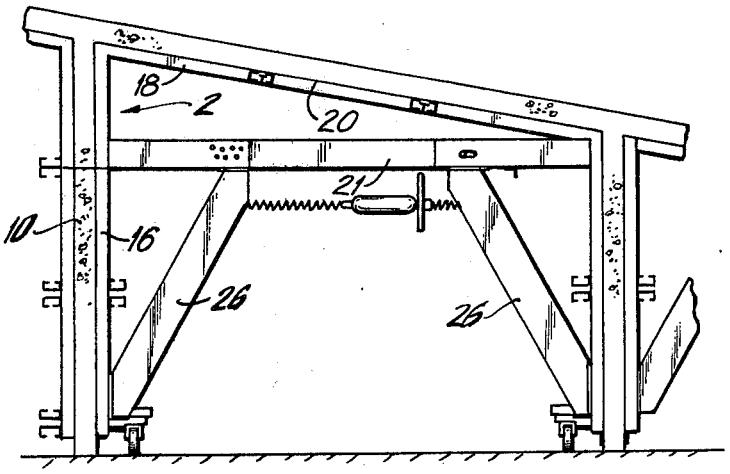
FIG. 11 is an end view of a portion of a concrete structure formed using an inside form unit of a type similar to that shown in FIG. 10.

In FIG. 10, another embodiment of the inside form units 2 is shown where the structure of the form units is approximately the same as displayed in FIG. 3, however, there is the difference that the top surface of the form unit in FIG. 10 is inclined rather than being horizontal as in FIG. 3. In FIG. 11, which is similar to FIG. 2, it can be noted that the roof of the concrete structure is inclined, as is the top surface of the inside form unit 2. A horizontal brace 21 extends across the inside form unit between the vertically extending legs 16.

The inside form units 2 shown in FIGS. 10 and 11 would be used in forming a continuous structure all located on the one level.

Figure 12:
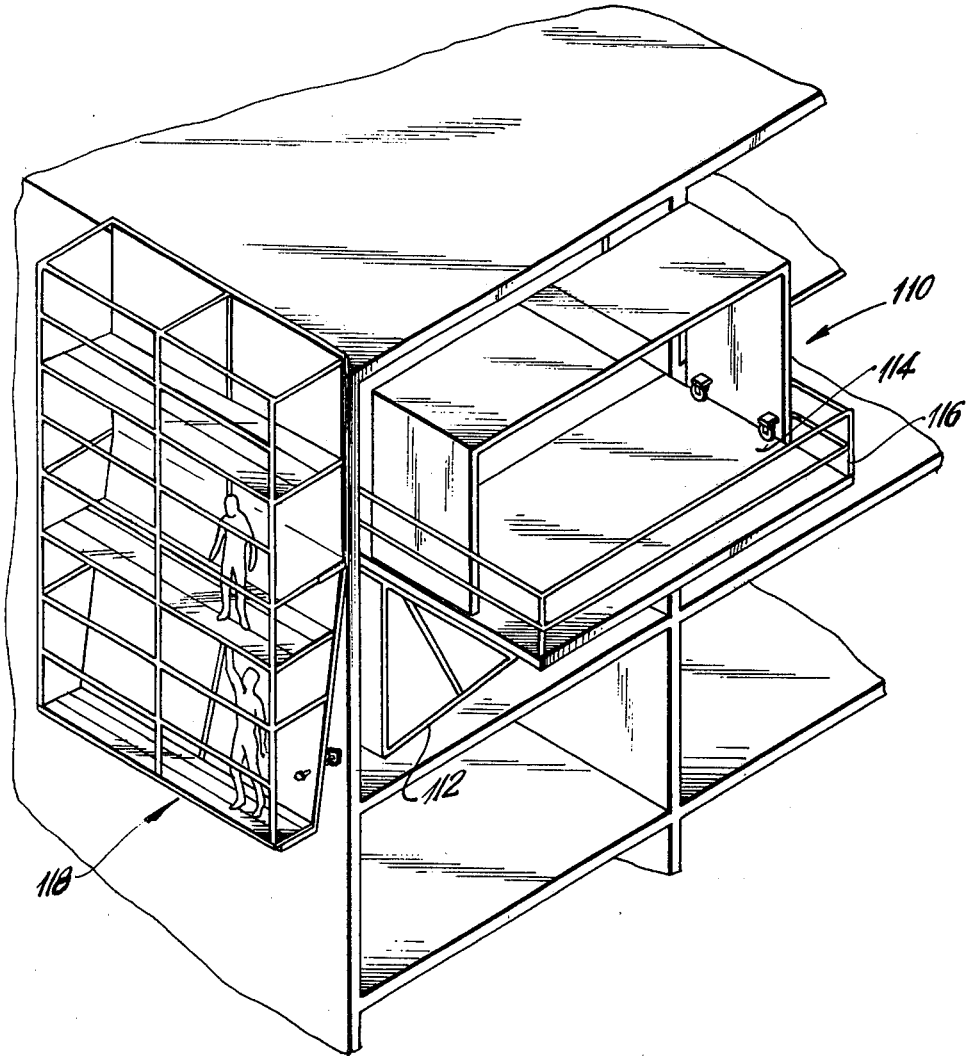
FIG. 12 is a perspective view illustrating a scaffolding arrangement for moving form members from one level to another in a building under construction.

In FIG. 12, a scaffolding unit 110 is shown placed on one end of a partially built multi-level building. The scaffolding unit 110 consists of a support structure 112 and a floor 114 with a fence or barricade 116 extending around the periphery of the floor 114. In addition to the scaffolding unit 110 at the end of the tunnel-like sections formed by the inside form units 2, another scaffolding unit 118 is fastened to the outside form units.

In commencing the construction of either a single-level or a multi-level building, the wall curbs 8 are first formed generally as a part of the floor slab of the building. As displayed in FIG. 1A, the curb walls are formed by using the cross-shaped and tee-shaped members 6. Though not shown, these members are utilized in positioning and supporting the forms for the wall curbs. In addition, any openings through the wall curbs are also formed, such as door openings and the like; note FIG. 1A where the interior wall curbs 8 are of an intermittent structure.

With the wall curbs formed, the first lift of forms can be positioned. Initially, the individual parts of the inside form units 2, that is, the L-shaped members 14 and the horizontal extension plate 20, are secured together by means of the alignment device 22, the central key 24 and the turnbuckle 28 so that the form unit has the proper width. The forms are provided with the rolling support members 30 so that they can be rolled into position between a pair of laterally adjacent and coextensive curb walls 8. The desired vertical aligning and leveling of the inside wall forms is achieved by the adjustment provided in the rolling support members 30 or 30A.

As can be seen in FIG. 1, each row of inside wall forms 2 provides a continuous tunnel-like arrangement. Adjacent inside form units forming each of the tunnels are connected together and aligned so that their side and top surfaces form continuous planar surfaces without any interruption or projection. After the forms in one of the tunnel-like rows are set, any frames or inserts are placed on the walls and also reinforcing steel can be placed in the spaces left between the adjacent sidewalls 14 of the inside form units and the adjacent sidewalls of the inside form units 14 and the outside form units 4 and on the top surfaces of the continuous tunnel-like sections. This procedure is repeated until all of the tunnel-like rows of inside form units are in position.

Outside wall forms 4 are positioned by means of the device shown in FIG. 9 and the spacer-connector rods 108 are placed through and connected to the forms so that they are adequately spaced and connected together. Though the structure of the forms has not been described in detail, it will be appreciated that all of the forms are reinforced and braced to withstand the flexure and deformation which occurs as the concrete is poured and vibrated inside the forms. With the outside wall forms in place, the bulkheads are positioned and the cross-shaped and tee-shaped members are positioned in the upper surface of the form to provide the wall curbs for the next vertical lift. As mentioned previously, wall curb forms, though not shown, are mounted on the members 6 along with adequate bracing and support.

Any openings or inserts in the top surface to be poured are set in place and the form is now ready to receive concrete.

After the concrete has been poured, vibrated and a sufficient time has passed for the concrete to set so that it is self-supporting, the steps just described are reversed for removing the forms. As is well known, the forms can be insulated or heat can be used to accelerate the setting of the concrete. After the removal of the spacer-connector rods 108, the inside form units 2 are ready to be removed. Initially, the wheels 44 or ball-shaped rolling members 48 of the rolling support members for the inside form units are moved upwardly from their supporting surfaces, the central keys 24 are lowered, and the turnbuckles 28 are operated for displacing the sidewalls of the form units inwardly for detaching or stripping the sidewalls from the poured concrete structure. As the sidewalls are separated from the concrete structure, the forms will drop downwardly so that the wheels or ball-shaped rolling members are again in contact with the support surface and the inside form units can now be moved for use in forming the next vertical lift.

As shown in FIG. 12, individual inside form units 2 can be moved out of the tunnel-like row and onto the floor 114 of the scaffolding unit 110 and from the scaffolding unit the form units can be lifted onto the upper surface of the previously formed lift and again moved into position for forming another vertical lift of concrete.

If a single-level structure is to be formed, either such as by using the inside form units 2 shown in FIGS. 10 and 11 or such as shown in FIGS. 1 and 1A, after the concrete has been poured and the forms stripped, they are moved horizontally to the next location and positioned against wall curbs, such as shown in FIG. 1A. Where only a single lift is being formed, it is not necessary to construct the wall curb forms on the upper surface of the form, however, the same steps for positioning, connecting and aligning the inside wall forms are used.

While a specific embodiment of the invention has been shown and described in detail to illustrate the application of the inventive principles, it will be understood that the invention may be embodied otherwise without departing from such principles.

I claim:

1. A form for use in constructing a poured concrete structure comprising an inside form unit having an inverted U-shape with upwardly extending, outwardly facing side surfaces and an upwardly facing top surface disposed transversely of the upper ends of the side surfaces, said inside form unit having an open front end and an open rear end with said side surfaces and top surface extending between the front and rear ends, said inside form unit comprising a pair of laterally spaced, inverted L-shaped members each having an upwardly extending first leg and a second leg secured to the upper end of and extending transversely of said first leg so that the upwardly facing surfaces of said second legs form at least a part of the top surface of said inside form unit, first means positioned between said second legs of said L-shaped members for forming in combination therewith a continuous closed planar surface between the upper ends of said first legs which planar surface defines the top surface of said inside form unit, said first means including a central key removably inserted into the plane of said second legs with said central key having an upwardly facing surface which is disposed in the continuous closed planar surface defining the top surface of said inside form unit when said central key is inserted into the plane of said second legs, second means connected to said L-shaped members for forcing said L-shaped members toward one another so that said central key is retained in position in the plane of said second legs, a plurality of said inside form units disposed in at least one row extending in the front end to rear end direction of said inside form units with the interiors of said inside form units affording a tunnel-like arrangement, fourth means mounted on said inside form units for connecting the front end of one said inside form unit to the rear end of another said inside form unit disposed in said one row for aligning the outwardly facing side surfaces and top surfaces of said inside form units, said fourth means comprising a support member secured to and extending along and closely spaced from the front end edges and rear end edges of said inside form units, a union clamp mounted on said support members for connecting said inside form units together, an aligning device mounted on said support members for aligning the outwardly facing surfaces of said inside form units, said support members including studs secured to and extending inwardly from said support members within said inside form units, said union clamp comprising an elongated plate having a dimension in the elongated direction sufficient to span the distances between said studs on said support members on the juxtaposed edges of said inside form units, each said plate having a slot extending inwardly from the edge of the plate extending in the elongated direction and said slot extending obliquely to the elongated direction, said slot arranged to fit over and in sliding engagement with one of said studs on one of the juxtaposed edges, said plate having an opening therethrough and said opening being elongated in the elongated direction of said plate and spaced from said slot, said opening arranged to fit over and in sliding engagement with one of said studs on the other one of the juxtaposed edges, a nut fixed to said plate on the opposite side of said opening from said slot, a threaded member secured into said nut and displaceable therethrough for contacting said stud through said opening so that by threading said threaded member through said nut into engagement with said stud in said opening the juxtaposed edges of said inside form units can be connected together.

2. A form, as set forth in claim 1, wherein said second means comprises a turnbuckle extending transversely between said first legs of said L-shaped members.

3. A form, as set forth in claim 1, wherein said first means comprises an extension plate having an upwardly facing surface located in the top surfaces of said inside form units, each extension plate having a first edge and a second edge with both edges extending from the front end to the rear end of an inside form unit, said first edge disposed in juxtaposed relation to the free edge of one of said second legs, fifth means mounted on said inside form unit for aligning the juxtaposed edges of said extension plate and the one of said second legs, said second edge of said extension plate spaced laterally from the free edge of the other one of said second legs and forming therebetween the space into which said central key is removably insertable.

4. A form, as set forth in claim 1, wherein a pair of rolling supports are secured to the lower end of each said first leg of said L-shaped members, said rolling supports spaced apart in the direction between the front and rear ends of said inside form units, said rolling supports including a rolling member so that said rolling member can roll said inside form unit, and means mounted in said rolling supports for moving said rolling members in the vertical direction.

5. A form, as set forth in claim 3, wherein said fifth means comprises a first support member attached to the one of said second legs and extending along and closely spaced from the edge thereof in juxtaposition to the edge of said extension plate, a second support member attached to said extension plate and extending along and closely spaced from the edge thereof in juxtaposition to the edge of the one of said second legs along which said first support member extends, an aligning guide bar secured to each said first and second support members and extending outwardly from said first and second support members away from said one of said second legs and said extension plate, a movable adjustment member connected to said one of said second legs and said extension plate, said adjustment member having a contact surface movable into contact with said aligning guide bars so that by biasing and aligning said guide bars by means of the contact surface the surfaces of said one of said second legs and said extension plate forming the top surface of an inside form unit can be aligned in the same plane.

6. A form, as set forth in claim 1, wherein said aligning device comprises an aligning rule secured to each of said support members located along juxtaposed edges of said inside form units, said aligning rules disposed opposite one another and extending outwardly from said support members away from the inside surfaces of said inside form units, and adjusting member connected to said supporting members and bridging said aligning rules, said adjusting member movably displaceable relative to said aligning rules and having a contact surface which aligns the surfaces of said inside form units when the contact surface bears evenly against the ends of said aligning rules.

7. A form, as set forth in claim 1, wherein said inside form units being arranged in at least two laterally disposed rows, outside form walls are spaced outwardly from said first legs of at least certain of said inside form units for defining a space therebetween for forming the outside wall of a poured concrete structure, spacer-connector rods extending through said outside form walls and said inside form units for spacing said outside form walls and said first legs of said inside form units apart and also for spacing laterally disposed said first legs of said inside form units apart.

8. A form, as set forth in claim 7, including support units which are arranged to be attached to the top ends of poured walls and to the outside form walls, and said support units including a device for adjusting the height of said outside form walls.

9. A form, as set forth in claim 7, wherein precast shapes are inserted between the upper ends of adjacent ones of said inside form units or between the upper ends of said inside form units and said outside form walls for providing a support for curb wall forms so that upwardly extending curb walls can be poured in the top surface of the concrete structure being formed.

10. A form, as set forth in claim 1, wherein said side surfaces of said inside form units are vertical and said top surfaces thereof are horizontal.

11. A form, as set forth in claim 1, wherein said side surfaces of said inside form units are vertical and said top surfaces thereof are inclined at an angle to the horizontal.

12. A form, as set forth in claim 4, wherein said rolling members are wheels.

13. A form, as set forth in claim 4, wherein said rolling members are ball-shaped.

* * * * *